United States Patent [19]

McGrath et al.

[11] 4,385,459

[45] May 31, 1983

[54] PHOTO TREE

[76] Inventors: John F. McGrath, 66 Annetta Ave., Northport, N.Y. 11768; Albert F. Candia, 532 Pond Path, Setauket, N.Y. 11733

[21] Appl. No.: 344,512

[22] Filed: Feb. 1, 1982

[51] Int. Cl.[3] ..... G09F 1/10; A47G 1/06; G09F 1/12; A63H 33/10

[52] U.S. Cl. ..... 40/124.4; 40/124; 40/605; 40/155; 46/31; 46/25

[58] Field of Search ..... 40/124.1, 124.2, 605, 40/611, 124, 124.4, 152, 152.1, 155, 156, 10 R; 46/31, 30, 25

[56] References Cited

U.S. PATENT DOCUMENTS

| | | | |
|---|---|---|---|
| 369,410 | 9/1887 | Pratt | 40/155 |
| 1,863,995 | 6/1932 | Ponstingl | 46/31 |
| 2,497,657 | 2/1950 | Cole | 40/605 |
| 2,499,535 | 3/1950 | Spreen | 40/152.1 |
| 3,323,801 | 6/1967 | Babcock | 40/124 |
| 3,817,396 | 6/1974 | Markson | 40/605 |
| 4,017,989 | 4/1977 | Murray | 40/152 |
| 4,115,938 | 9/1978 | Belmuth et al. | 40/152 |
| 4,209,927 | 7/1980 | Donatelle | 40/155 |
| 4,315,376 | 2/1982 | Eichenauer | 40/124.4 |

*Primary Examiner*—Gene Mancene
*Assistant Examiner*—Michael J. Foycik, Jr.
*Attorney, Agent, or Firm*—Leonard Belkin

[57] ABSTRACT

A photo display apparatus utilizing an assembly of slats having dados for permitting them to be meshed together in two or three dimensional configurations and provided with grooves in the sides for supporting the photographs.

5 Claims, 5 Drawing Figures

PHOTO TREE

BACKGROUND OF THE INVENTION

This invention relates to a photo display apparatus and more particularly to a modular frame system for displaying photographs and similar types of material.

A variety of assemblies for the display of photographs and the like which are available and in common use are either complicated in construction when they are made to be adjustible or they lack the ability to adjust readily to different sizes of display materials or to provide for changing the arrangement of the photographs. Typical such devices are shown in U.S. Pat. Nos. 3,323,801, 4,017,989, 4,115,938, and 4,209,922 as well as British Pat. No. 17,503 issued on July 31, 1907. The British patent is very limited in the type of display which can be arranged, as is the case in all of the U.S. patents noted. In addition, it will be seen that the assembly of some of the arrangements can be quite involved and cumbersome.

SUMMARY OF THE PRESENT INVENTION

The present invention overcomes many of the shortcomings of existing photographic display assemblies by providing a construction which is simple to use and yet is capable of handling all sizes of photographs and producing an almost unlimited variety of display configurations including three dimensional arrangements. Another feature of this invention is that the configuration selected may be for either wall mounting or free standing such as on a platform or a floor.

In a preferred embodiment of this invention, there is provided an assembly of slats meshed together to form apparatus for displaying photographs and the like. Each slat consists of an elongated member square or rectangular in cross section with grooves formed in at least two opposite sides of each slat, each groove extending in the direction of the elongated length of the slat, the depth and thickness of each groove being suffucient to accomodate the photographs to be displayed. Each slat is also provided with at least two dados in a side without a groove, said dados extending at right angles to the length of the slat and to a depth of about one-half the thickness of the slat. The slats are joined together into the display assembly by meshing the dados of different slats together. With this type of construction a large variety of display arrangements is possible, depending on the number of slats involved, the number of dados on each slat, and the placement of the dados. In addition, the assembly can be wall mounted or provided with a stand for floor or platform mounting.

In an alternative embodiment, grooves may be provided on all four sides of the slats which may be square, with the result that a three dimensional display can be produced, and the unit can be made free standing without the use of a separate stand to maintain it upright.

It is thus a principal object of this invention to provide a modular frame system for the display of photographs and the like capable of easy assembly into a variety of configurations.

Other objects and advantages of this invention will be obvious from the following description of preferred embodiments of this invention.

DESCRIPTION OF THE PREFERRED EMBODIMENTS

Figure 1:
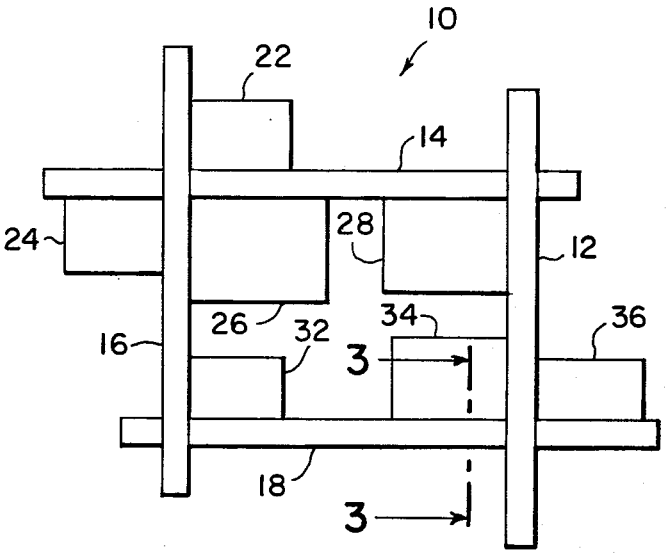
FIG. 1 is a front view of a preferred embodiment of a photo display apparatus assembled in accordance with the principles of this invention.

Referring to FIG. 1, there is illustrated a photo display assembly 10 consisting of slats 12, 14, 16, and 18 supporting a variety of photo displays 22, 24, 26, 28, 32, 34 and 36. Each of the aforementioned displays may consist of photographs sandwiched between clear plastic covers or envelopes of transparent material which are supported in grooves formed in slats 12–18.

Figure 2:
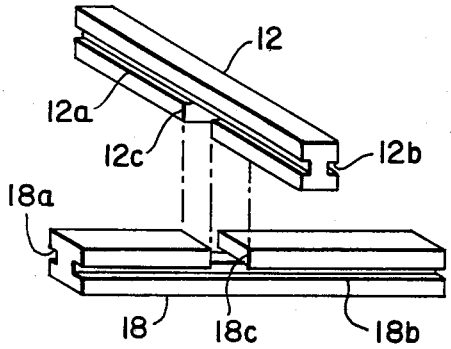
FIG. 2 is an exploded, isometric view of two slats assembled.
Figure 3:
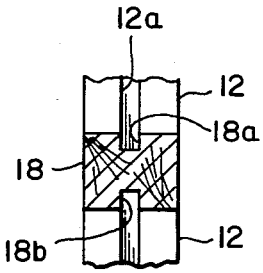
FIG. 3 is a view along 3—3 of FIG. 1.

Details of the slats and their assembly are shown in FIG. 2 in which is illustrated slats 12 and 18 in an exploded view. It will be seen that slat 12 is rectangular in cross section and is provided with a pair of grooves **12*a* and 12*b* on opposite faces, while slat 18 is similarly provided with grooves 18*a* and 18*b*. In addition, for meshing the slats together to form an assembly, each slat is provided with at least two dados or notches, such as dado 12*c* in slat 12, and dado 18*c* in slat 18. The dados extend halfway through the thickness of each slat, and have a width equal to the width of its mating or meshing dado, as shown in FIG. 2. This results, when assembled, in the meshing slats having their surfaces flush with each other as shown in FIG. 3**. The slats preferably are made out of wood for ease of manufacture, but of course other materials could be employed, such as plastic.

In the arrangement shown in FIGS. 1–3, the slats as already noted are rectangular in cross-section and can be supported on a wall by the use of picture hangers or nails. A platform (not shown) would be employed for a free-standing display.

Figure 5:
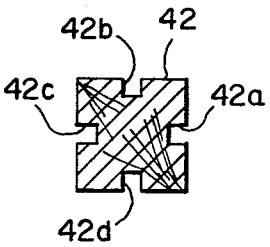
FIG. 5 is a section along 5—5 of FIG. 4.
Figure 4:
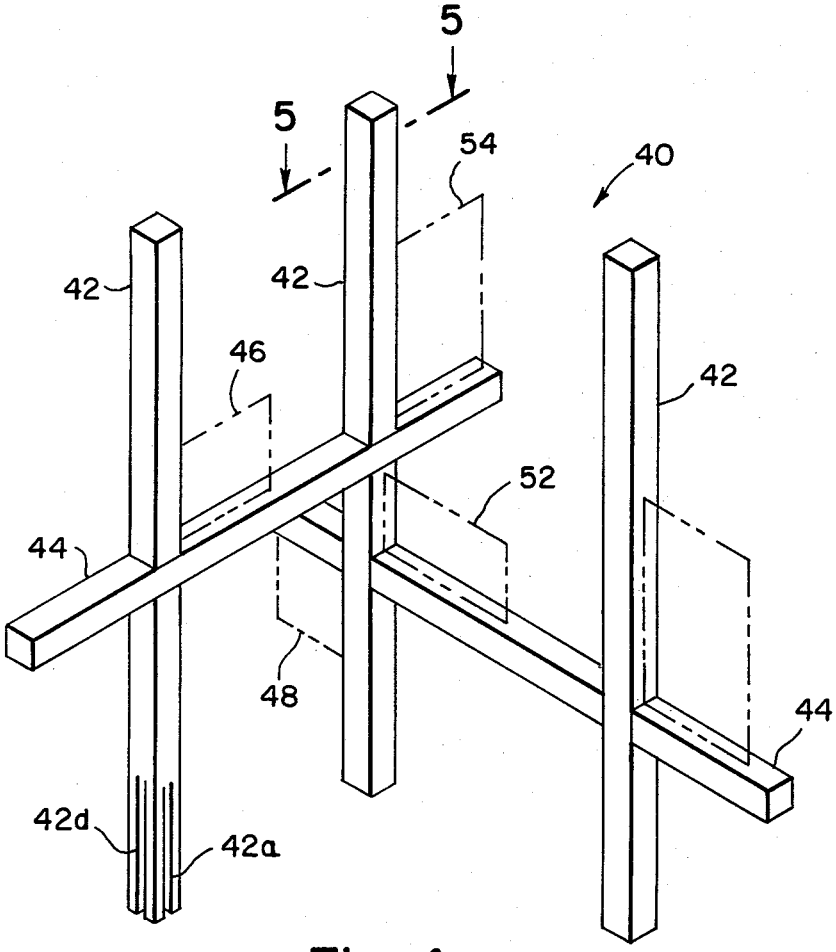
FIG. 4 is an isometric view of a three dimensional display.

The principles of this invention can also be embodied into a three dimensional assembly by using slats which are square in cross section, and grooves can be employed on three or all four sides of the slats. Referring to FIGS. 4 and 5, a typical three dimensional arrangement 40 consists of vertical slats 42 and horizontal slats 44, assembled together in the manner shown in FIG. 2 except for the three dimensional orientation. As best seen in FIG. 5, the slats making up this arrangement would be provided as shown in slat 42 by way of example, with grooves **42*a*–42*d* on all four sides, thereby making it possible to place photographic displays 46, 48, 52 and 54** in the manner illustrated.

It will also be noted that the arrangement shown in FIG. 4 is completely free standing so that it can be placed anywhere there is a horizontal surface, and that a variety of other arrangements are possible, by changing the number of slats and how they are slotted and put together.

It is thus seen that there has been provided a unique apparatus for the display of photographs and the like of simple and inexpensive construction which is also capable of a variety of configurations.

While only certain preferred embodiments of this invention have been described it is understood that a variety of changes are possible without departing from the principles of this invention.

What is claimed is:

1. Apparatus for the display of photographs and the like comprising a plurality of slats, each slat consisting of an elongated member rectangular in cross section, grooves formed in at least two opposite sides of each slat, each groove extending in the direction of the elongated length of said slat, the depth and thickness of each groove being sufficient to accomodate the photographs to be displayed, each of said slats being provided with at least two dados in a side without a groove, said dados extending at right angles to the length of the slat and to a depth of about one-half the thickness of said slat, said slats being assembled into an interlocked structure in which the dados of joined slats are meshed together, forming a rigid assembly in which said photographs are supported by insertion in said grooves.

2. The apparatus of claim 1 in which said photographs are encased in transparent envelopes which are inserted in said grooves for support and display.

3. Apparatus for three dimensional display of photographs and the like comprising a plurality of slats, each slat consisting of an elongated member square in cross section, grooves formed in all four sides of each said slat, each groove extending in the direction of the elongated length of each said slat, the depth and thickness of each groove being sufficient to accomodate the photographs to be displayed, each of said slats being provided with at least one dado on a side, said dado extending at right angles to the length of the slat and to a depth of about one-half the thickness of said slat, said slats being assembled with the dados mated together in a flush fit forming an interlocked, rigid structure in which said photographs are supported by insertion in said groove.

4. The apparatus of claim 3 in which some of said slats have dados on more than one surface thereof to form the three dimensional assembly with some photographs facing at a 90° angle with respect to other photographs.

5. The apparatus of claim 4 in which the slats are arranged so as to produce a free standing structure.

* * * * *